US005078283A

United States Patent [19]

Wilson

[11] Patent Number: 5,078,283

[45] Date of Patent: Jan. 7, 1992

[54] CUSTOMER CONVENIENCE CENTER

[76] Inventor: Jewell E. Wilson, 1409 S. 15th Ave., Yakima, Wash. 98902

[21] Appl. No.: 563,108

[22] Filed: Aug. 6, 1990

[51] Int. Cl.[5] ..... A47F 5/00

[52] U.S. Cl. ..... 211/187; 160/135; 211/189

[58] Field of Search ..... 211/189, 187; 160/135; 40/124, 125

[56] References Cited

U.S. PATENT DOCUMENTS 3,931,894 1/1976 Murphy ..... 211/189

4,969,568 11/1990 Yoshida ..... 211/189 X 4,981,226 1/1991 Shallenberg et al. ..... 211/189

*Primary Examiner*—Robert W. Gibson, Jr.

*Attorney, Agent, or Firm*—George A. Cashman

[57] ABSTRACT

A customer convenience center, or merchandise display stand, for use principally in convenience stores, the stand having a metal base frame on legs or casters or a combination thereof, perforated hardboard panels resting on the frame, said panels retained in place by metal uprights, and said uprights retained in place by a top frame enclosing the uprights. A planar top covers the top frame. Shelf bracket standards may be attached to the perforated hardboard panels as desired for support of shelf brackets and shelves.

13 Claims, 6 Drawing Sheets

CUSTOMER CONVENIENCE CENTER

BACKGROUND OF THE INVENTION

1. Field of the Invention

Convenience stores usually offer a comparatively large variety of goods, but have a limited amount of floor space on which to install display shelving. Customarily, in such stores, there is open space between the purchase counter and the conventional straight-row shelving. Operators of convenience stores have the objective of displaying the maximum amount of goods in these open spaces, using a minimum amount of floor area. At the same time, it is recognized that merchandise comes in different physical sizes, with many different forms of packaging, some suitable for shelf display, and some suitable for suspending from a hook or bracket. In addition, merchandise storage space is at a premium in such stores.

It is an object of this invention to provide a customer convenience center, or display fixture, that occupies a relatively small amount of floor area, and yet will permit the display of a relatively large amount of goods of different sizes, and having different forms of packaging.

It is a further object of this invention to provide a display fixture that may be assembled and disassembled by unskilled personnel without the use of tools.

It is a further object of this invention to provide a display fixture that can be moved easily from one location in the store to another.

It is a further object of this invention to provide a fixture having interior space for storage of replacement display goods.

It is a further object of this invention to provide a basic design that can be manufactured in different shapes to accommodate varying store open space layouts.

2. Description of the Related Art

The inventor's search failed to uncover merchandise display stands that appeared to be in any way similar to this invention. There are numerous movable partitions and sign displays, the patents for which are included in this application.

SUMMARY OF THE INVENTION

The merchandise display stand of this invention is formed of an assembly having a metal tube base frame in the form of a polygon. A small triangular gusset plate is welded across each interior angle of the polygon on the under side thereof. The frame is supported off the floor by straight legs, or a combination of legs and casters, one at each angle of the polygon. Sheet metal angles are placed upright in each angle of the polygon, resting on the gusset plates. Rectangular hardboard sheets with beveled sides are placed on clips which extend inward from the base frame, and with the beveled sides of the hardboard sheets within the sheet metal uprights. The top of the assembly is held together with an angle-iron top frame, the interior of which faces downward. The sides of the top frame enclose the upper ends of the uprights and the top edges of the hardboard sheets. A flat top may be rested on the top frame with its edges extending outward beyond the top frame.

DETAILED DESCRIPTION OF THE INVENTION

This specification will refer principally to FIGS.1–5 which disclose a display stand having the shape, in plan, of an equilateral triangle. It will be understood that this invention may be manufactured also in the form of a rectangle, or a pentagon as illustrated in FIG.6, or in the form of a polygon with any desired number of sides, without departing from the spirit of the invention.

Figure 1:
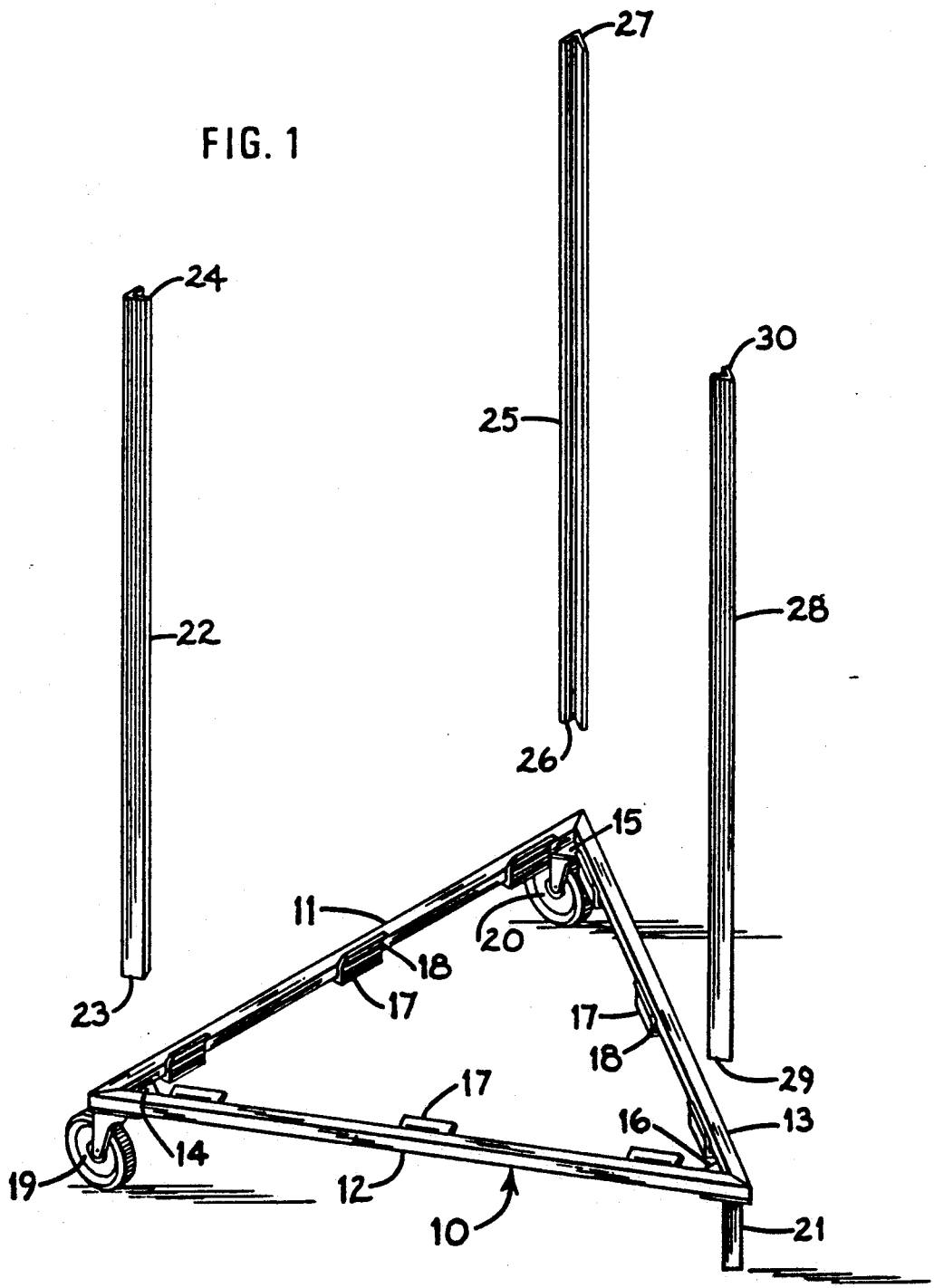
FIG.1 is a perspective view of the base frame of a triangular display stand, with uprights in position for insertion therein.
Figure 4:
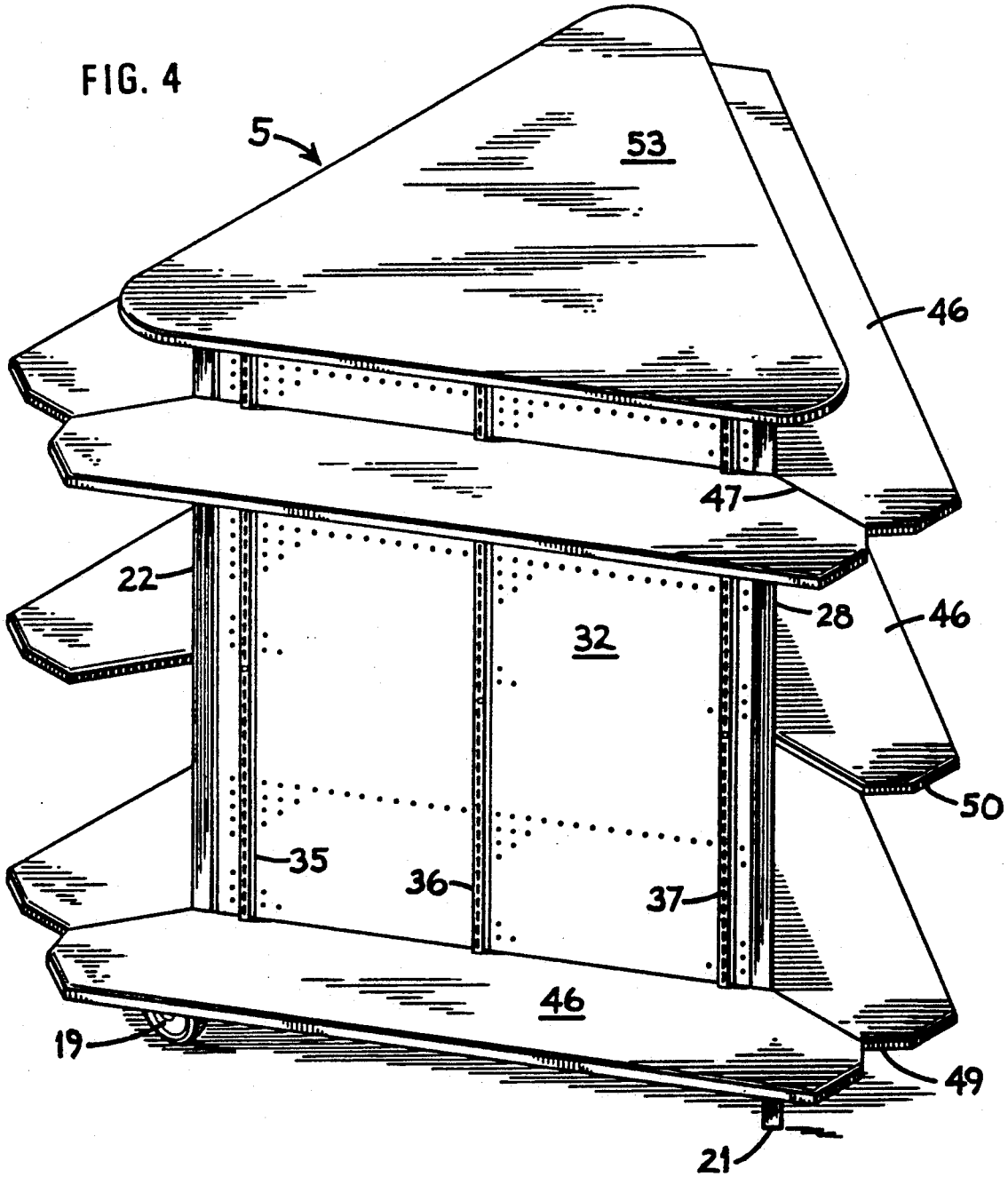
FIG.4 is a perspective view of the display stand of FIG.3 completely assembled.

Referring particularly to FIG.1, there is disclosed a base frame 10 for display stand 5 (which is illustrated completely assembled in FIG.4). Base frame 10 comprises sides 11, 12 and 13, which, preferably, are manufactured of rectangular metal tubing. Triangular gussets 14, 15 and 16 are welded across the interior angles of base frame 10 at the lower side of base frame 10. Clips 17 are welded to base frame 10 and extend interiorly thereof, with the sides 18 of clips 17 spaced apart from base frame 10 a sufficient distance to receive a hardboard panel, which will be described below. Casters 19 and 20 are attached to gussets 14 and 15 respectively. Straight leg 21 extends downward from gusset 15 a sufficient distance so that base frame 10 is level with respect to the floor on which display stand 5 rests. Display stand 5 may, of course, be provided with straight legs 21 at each corner, or casters 19 at each corner, or any desired combination thereof. Upright 22 has a lower end 23 and an upper end 24. Upright 25 hasd a lower end 26 and an upper end 27. Upright 28 has a lower end 29 and an upper end 30. Each upright is formed of a sheet metal strip folded along its longitudinal centerline to an angle no greater than the interior angle of the base frame within which the upright is placed. For example, with the display stand 5, the upright would be folded to form an interior angle of not more than 60 degrees, and preferably to an angle of slightly less than 60 degrees—57 degrees, for example —for a purpose which will be disclosed below. In FIG.1, upright 22 is illustrated with its lower end 23 directly above gusset 14, as it would be positioned prior to assembly. Lower end 26 of upright 25 is positioned above gusset 15, and lower end 29 of upright 28 is positioned above gusset 16.

Figure 2:
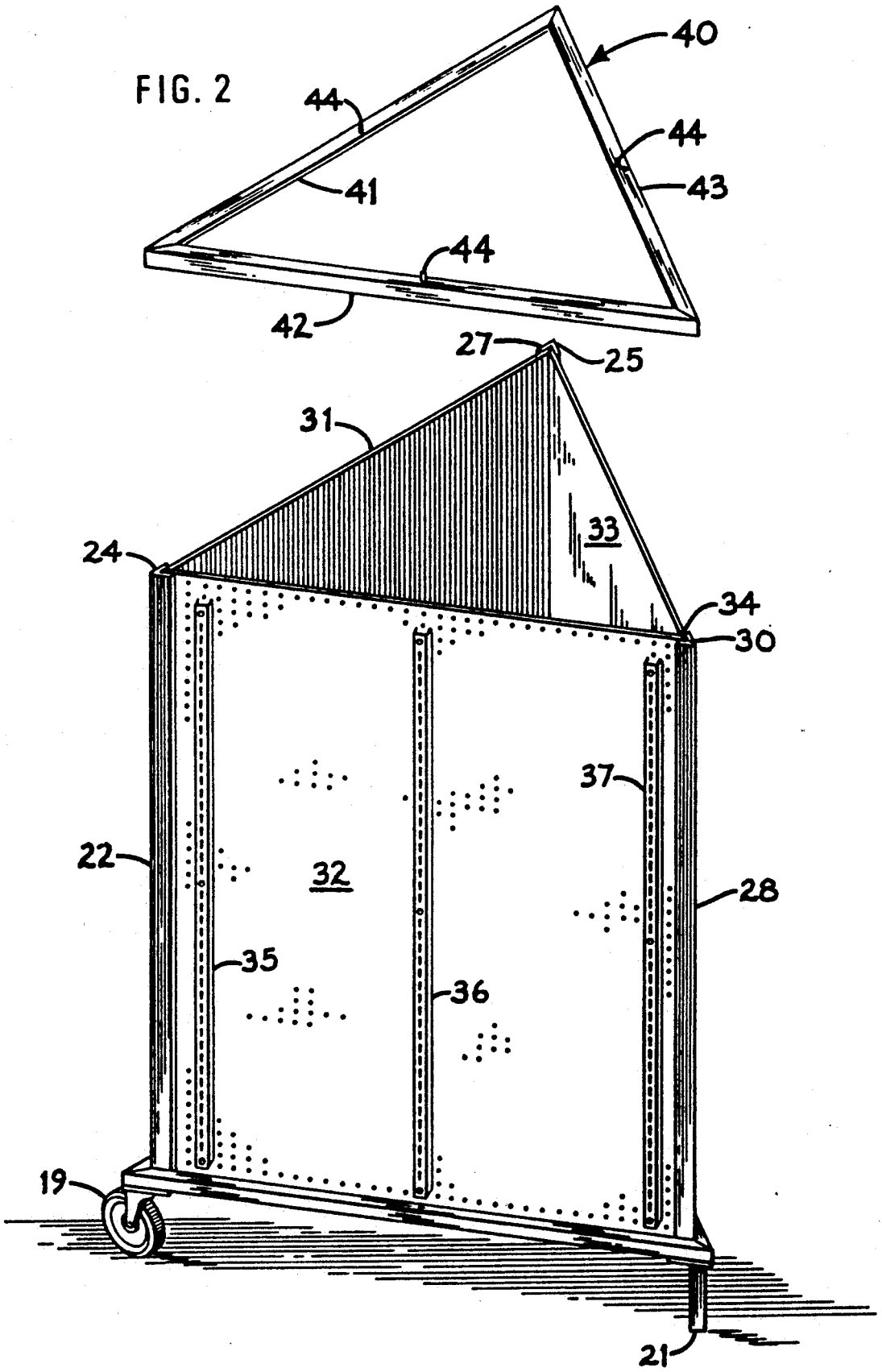
FIG.2 is a perspective view of the display stand of FIG. 1, partially asembled, with the top frame in position for placement on the uprights.

Referring now to FIG.2, it can be seen that uprights 22, 25 and 28 have been rested upon gussets 14, 15 and 16 respectively. Perforated hardboard panel 31 has been placed on clips 17 which extend inwardly from side 11 of base frame 10. The upright sides of panel 31 have been placed within the angles of uprights 22 and 25. Perforated hardboard panel 32 has been placed on clips 17 which extend inwardly from side 12 of base frame 10. The upright sides of panel 32 have been placed within the angles of uprights 22 and 28. Perforated hardboard panel 33 has been placed on clips 17 which extend inwardly from side 13 of base frame 10. The upright sides of panel 33 have been placed within the angles of uprights 25 and 28. The sides of panels 31, 32 and 33 are beveled at equal angles as shown at 34 to provide a snug fit within the uprights. The purpose of forming uprights 22, 25 and 28 with an angle sightly smaller than the interior angle of the base frame 10 is to provide a tight fit for the upright sides of the panels which would be placed within the uprights 22, 25 and 28. Shelf bracket standards 35, 36 and 37 are attached symmetrically to panel 32 by means of bolts 38. Similarly, shelf bracket standards (not shown) are attached to panels 31 and 33. Top frame 40 comprises sides 41, 42 and 43. The length of sides 41, 42 and 43 of top frame 40 is such that when top frame 40 is placed on the assembly illustrated in FIG.2, top frame 40 will tightly enclose upper ends 24, 27 and 30 of uprights 22, 25 and 28 respectively. Short studs 44 extend upward from approximately the midpoint of sides 41, 42 and 43 of top frame 40.

Figure 3:
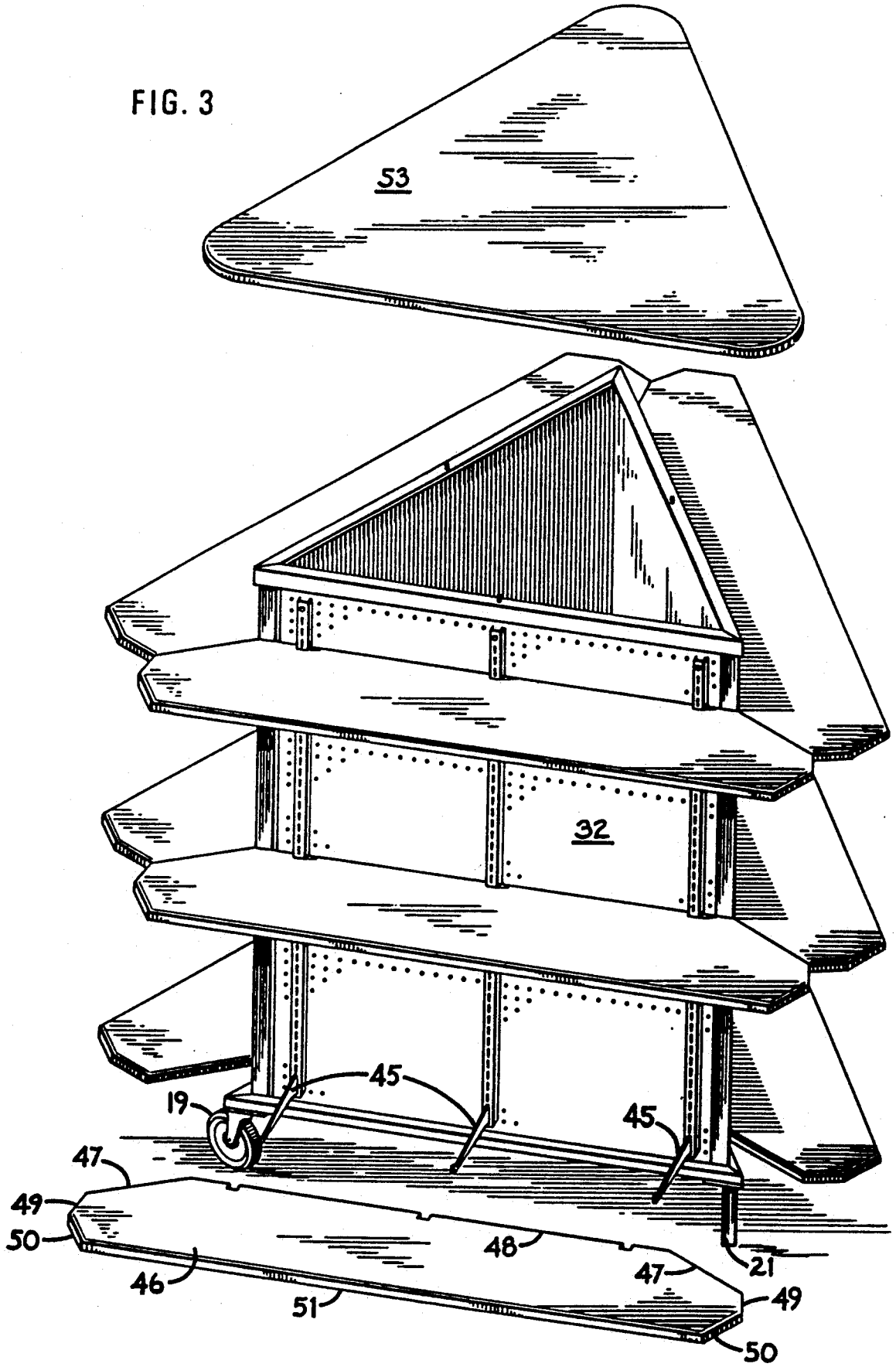
FIG.3 is a perspective view of the display stand of FIG.2, with shelving installed thereon, and with the top cover and one shelf ready for installation.

Referring now to FIG.3, brackets 45 may be seen extending outwardly from shelf bracket standards. Brackets 45 and standards 35, 36 and 37 are commercially available hardware items in which the brackets may be attached to the standards at any desired height along the standard. A shelf 46 is shown as it appears before being assembled to display stand 5. All shelves 46 are identical, and are provided with angled end portions 47. The angle between the angled end portion 47 and the back edge 48 of the shelf is 180 degrees minus one-half the interior angle of the base frame or top frame. Each shelf 46 is provided with an end portion 49 approximately perpendicular to back edge 48, and with an angled end portion 50 which forms an angle of approximately 135 degrees with the front edge 51 of shelf 46. Notches 52 are provided in back edge 48 to accommodate standards 35, 36 and 37, for example, so that back edge 48 of shelf 46 will fit snugly against panel 32, for example. The shelves 46 may be of any convenient depth, and may be provided with a front lip. In the preferred embodiment, the shelves 46 are manufactured of vinyl-covered particle board. Top cover 53 has the shape of an equilateral triangle and is larger in plan area than top frame 40. Top cover 53 is provided with recesses (not shown) in its lower surface which cooperate with studs 44 projecting upward from top frame 40. The purpose of studs 44 is to prevent top cover 53 from shifting if pushed accidentally.

FIG.4 illustrates the completely assembled merchandise display stand 5. In FIG.4 a shelf 46 has been omitted to provide more panel space for displaying the kinds of merchandise packages which are suspended from a hook (not shown) or a bracket (not shown) cooperating with perforations in the panel. It may be seen that the number of shelves may be changed, and the height of shelves may be varied, to accommodate merchandise of varying sizes and methods of packaging.

Figure 5:
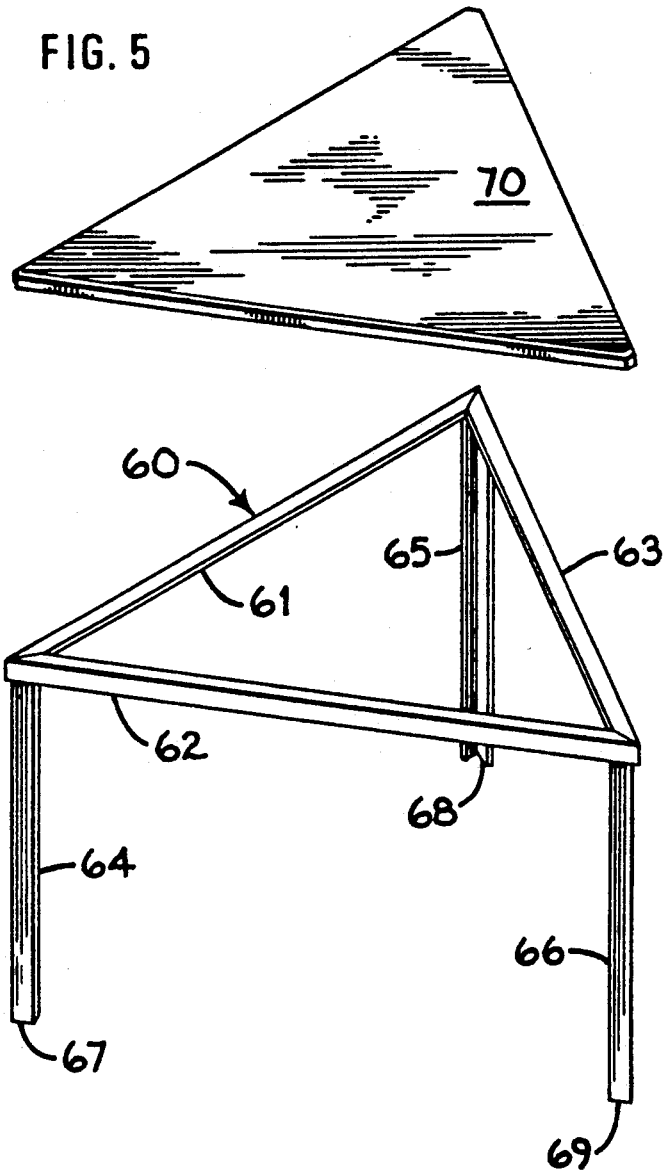
FIG.5 illustrates the two pieces required to provide storage space within the display stand of FIG.4.
Figure 6:
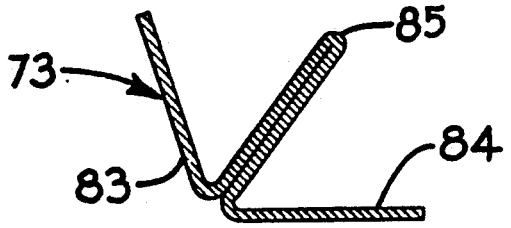
FIG.6 illustrates, in an enlarged scale, the cross-section of an upright suitable for use with the display stand of FIG.7.

A means to provide storage space within display stand 5 is illustrated in FIG.5. Angle-iron storage frame 60 includes sides 61, 62 and 63 which are joined to form a triangle of such size that the storage frame 60, when held approximately horizontally, will fit within top frame 40. Angle-iron legs 64, 65 and 66 extend downwardly from the corners of storage frame 60. With cover 53 removed, storage frame 60 is placed within display stand 5 with legs 64, 65 and 66 directed downwardly. Storage frame 60 is lowered until the lower ends 67, 68 and 69 of legs 64, 65 and 66 are resting on gussets 14, 15 and 16 respectively. Storage floor 70, which has the same or slightly smaller dimensions as the triangle formed by sides 61, 62 and 63 of storage frame 60, is then placed on top of storage frame 60. Replacement merchandise items may then be stored within the display stand.

Figure 7:
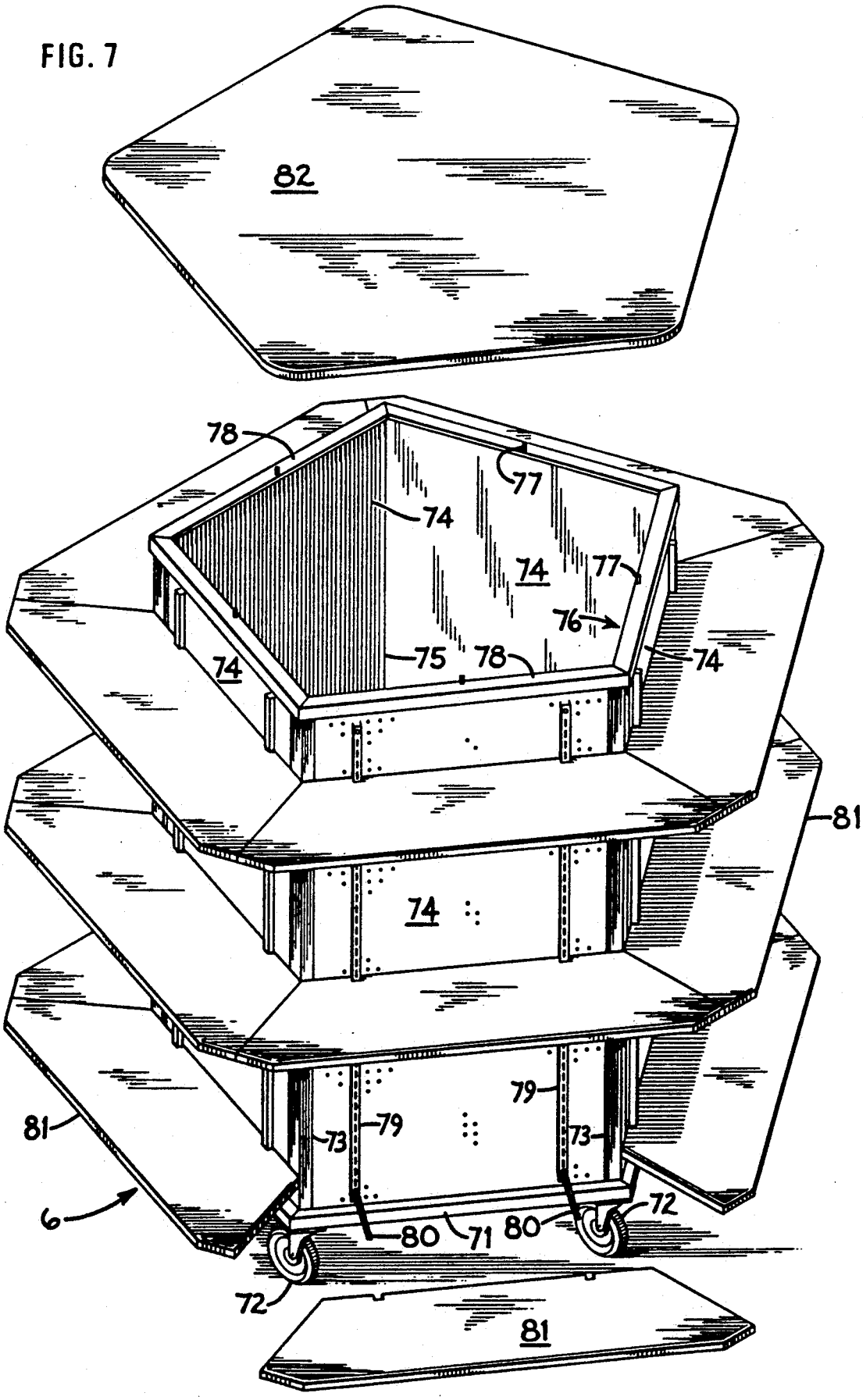
FIG.7 illustrates an assembled display stand having the outline of a pentagon.

As an illustration of the versatility of this invention, a pentagonal display stand 6 is illustrated in FIG.6. The pentagonal display stand 6 utilizes the same principles of construction as disclosed for the triangular display stand described earlier in this specification, and illustrated in FIGS. 1-5. Referring specifically to FIG.6, the display stand 6 comprises pentagonal base frame 71 supported on casters 72. Metal uprights 73, the cross-section aspect of which are illustrated in FIG.7, rest on gussets (not shown) attached to base frame 71. Perforated hardboard panels 74 have their vertical sides 75 enclosed within the folds of uprights 73. Top frame 76 rests on uprights 73 and encloses uprights 73 in a retaining relationship, thereby keeping panels 74 in the proper orientation. Studs 77 extend upward from the approximate midpoints of each member 78 of top frame 76. Studs 77 serve to locate top cover 82 and keep top cover 82 in position when it is placed on top frame 76. Shelf bracket standards 79 are bolted to panels 74 as illustrated in order to support shelf brackets 80. Shelves 81 are supported by shelf brackets 80. The cross-sectional appearance of an upright 73 is illustrated in FIG.7. The included angle within which the upright edges 75 of the panels 74 are placed must be less than 90 degrees in order to retain panels 74 in proper position. Upright 73, therefore, has side 83 and side 84 which form an angle of 108 degrees or slightly less. Center section 85, formed of a fold of the metal, bisects the angle between sides 83 and 84.

While this invention is susceptible of embodiment in different forms, the drawings and the specification illustrate preferred embodiments of the invention, with the understanding that the present disclosure is to be considered an exemplification of the principles of the invention, and the disclosure is not intended to limit the invention to the particular embodiments described.

I claim:

1. A merchandise display stand comprising:

a base frame formed of horizontally disposed members joined at their ends to form a polygon;

a plurality of rectangular planar backboards supported by the members of the base frame, the number of backboards being equal to the number of members forming the polygon of the base frame, and each such backboard having a horizontal lower edge, a horizontal upper edge, and vertical side edges, and the upper and lower edges of each backboard being of equal length and being slightly shorter in length than the base frame member on which it is supported;

a plurality of upright members, the number of upright members being equal to the number of members forming the polygon of the base frame, each upright member having a lower end and an upper end, each upright member being supported at its lower end by the base frame within an interior angle of the base frame, and said upright members providing a positioning and retaining means for the side edges of the backboards;

a means on the base frame to support the lower edges of the backboards;

a means on the base frame for supporting the lower ends of the upright members; and a top frame formed of horizontally disposed members joined at their ends to form a polygon of the same shape as the base frame, said top frame resting on the upper ends of the upright members and enclosing said upper ends of the upright members in a retaining relationship.

2. The merchandise display stand of claim 1 wherein the base frame comprises a plurality of members manufactured of rectangular tubing.

3. The merchandise display stand of claim 1 wherein the means on the base frame to support the lower edges of the backboards comprises a plurality of clips extending upwardly and spaced apart from, the inner side of each horizontal member, each of said clips comprising an L-shaped member with the lower leg of the L-shaped member secured to the underside of a given horizontal member of the base frame, and with the vertical leg of the L-shaped member parallel to and spaced apart from the inner side of a horizontal member a sufficient distance to receive a hardboard panel within the space, with the lower edge of the panel resting on the lower lag of the clip.

4. The merchandise display stand of claim 1 wherein the means for supporting the lower ends of the upright members comprises a triangular gusset underlying each corner of the base frame, and with the web of the gusset extending inwardly from the corner a sufficient distance to support the lower ends of the upright members.

5. The merchandise display stand of claim 1 wherein the upright members comprise narrow strips of sheet metal bent along their longitudinal centerlines to form an angle no greater than the particular interior angle of the base frame within which the upright member is resting.

6. The merchandise display stand of claim 4 wherein the positioning and retaining means for the side edges of the backboards comprises:

each of the side edges of adjacent backboards being beveled at an angle to its planar surface of approximately one-half the interior angle of the base frame within which each said side edge rests;

the beveled side edges of adjacent backboards being in substantial contact with each other; and said side edges of adjacent backboards being placed within the angle formed within the upright member at the interior angle of the base frame at which the upright member is placed.

7. The merchandise display stand of claim 6 wherein the top frame comprises angle-iron members attached to each other at their ends and formed into a polygon of the same shape as the base frame, the polygon so formed being of a sufficient size to enclose tightly the upper ends of the upright members when the top frame is placed on said upper ends with the flat side of the top frame upwards.

8. The merchandise display stand of claim 6 wherein the backboards have a plurality of equally spaced perforations in equally spaced vertical and horizontal rows, and all perforations being of uniform size.

9. The merchandise display stand of claim 8 further comprising a plurality of shelf bracket standards symmetrically mounted on each backboard in a vertical orientation.

10. The merchandise display stand of claim 4 further comprising a plurality of legs supporting the base frame above the floor, said legs being straight members of equal length attached to the gussets and extending vertically downward therefrom.

11. The merchandise display stand of claim 4 further comprising a plurality of wheeled casters attached to the gussets and extending downward therefrom.

12. The merchandise display stand of claim 4 further comprising a wheeled caster attached to and extending downward from each gusset but one, and a straight leg extending downward from the remaining gusset for the same distance as the bottoms of the caster wheels extend below the gussets.

13. The merchandise display stand of claim 7 further comprising a storage unit comprising:

a polygonal storage frame of a shape similar to the top frame and slightly smaller in outside dimension than the inner edges of the top frame so as to fit within the top frame;

a straight leg extending downward from each corner of the storage frame, each such leg being approximately half the length of any of the uprights, and said legs resting upon the gussets when the storage frame is lowered into the interior of the merchandise display stand; and a planar member having the same shape in outline as the polygon of storage frame, and being of the same size as the polygon forming the storage frame, said planar member resting atop the storage frame.

* * * * *